United States Patent [19]

Stephansen

[11] Patent Number: 4,594,795

[45] Date of Patent: Jun. 17, 1986

[54] AIR BEARING SUPPORT APPARATUS FOR DRYING A MOVING WEB

[76] Inventor: Erik Stephansen, 1504 Black Mountain Rd., Hillsborough, Calif. 94010

[21] Appl. No.: 663,879

[22] Filed: Oct. 23, 1984

[51] Int. Cl.[4] ..... F26B 13/20

[52] U.S. Cl. ..... 34/68; 34/4; 34/41; 34/156

[58] Field of Search ..... 34/68, 4, 41, 155, 156, 34/160

[56] References Cited

U.S. PATENT DOCUMENTS 3,324,570 6/1967 Flaith et al. ..... 34/156

3,793,741 2/1974 Smith, Jr. ..... 34/155

4,494,316 1/1985 Stephansen et al. ..... 34/68

*Primary Examiner*—Larry I. Schwartz

[57] ABSTRACT

A cross-direction web dryer, for example, for a paper making machine, provides air bearing support for the moving web by use of an elongated structural member with dryer modules on one side of the paper and an elongated reflector unit on the opposite side. Each of these elongated members include solid barriers next to the moving web at least one of the barriers being transparent to the heat producing radiation and with both barriers having juxtaposed slits through which air is forced from a blower to provide the air bearing. These slits extend substantially the width of the support and are aligned in the machine direction of the moving web.

5 Claims, 6 Drawing Figures

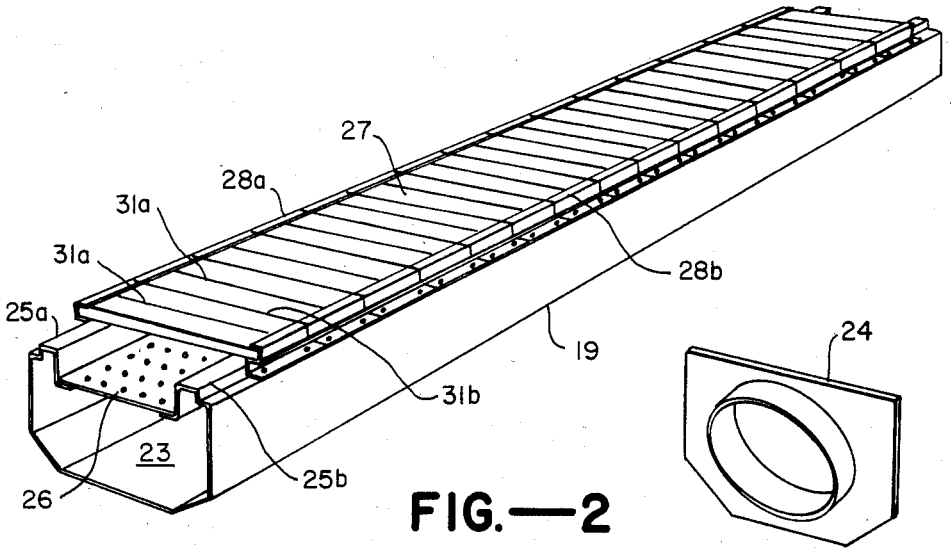
FIG.—2
FIG.—2A
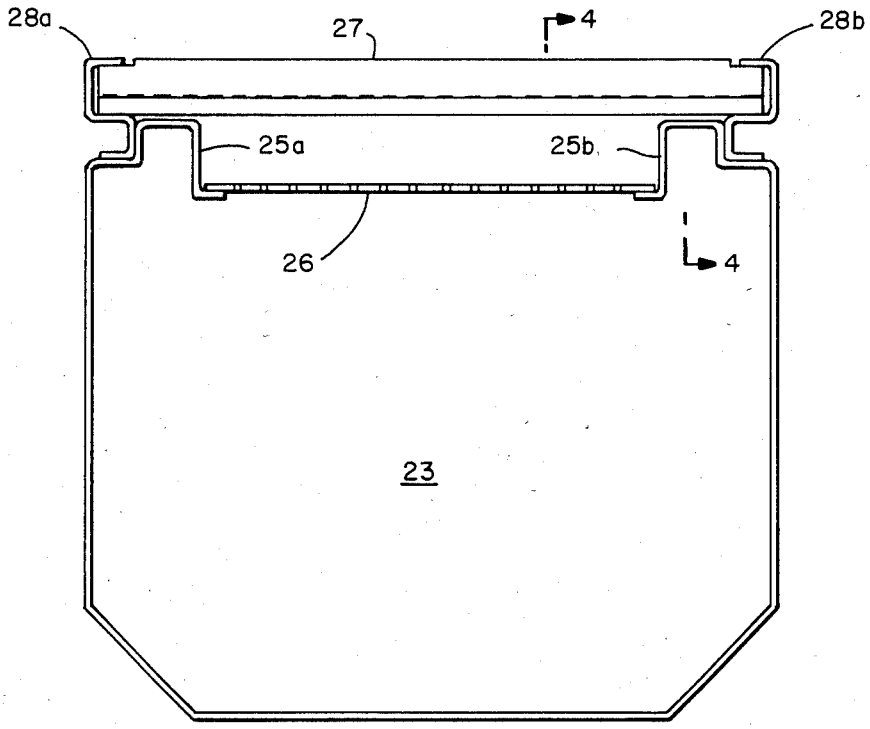
FIG.—3

AIR BEARING SUPPORT APPARATUS FOR DRYING A MOVING WEB

BACKGROUND OF THE INVENTION

The present invention is directed to air bearing support apparatus for drying a moving web and more particularly an apparatus which includes radiant heaters located in the cross-direction of the moving web which may be individually controlled to provide an even moisture profile.

As, disclosed in a co-pending application, Ser. No. 475,125, filed Mar. 14, 1983, in the name of ERIK STEPHANSEN ET AL, and entitled APPARATUS FOR DRYING A MOVING WEB, and now U.S. Pat. No. 4,494,316, in the paper making industry where there is a continuously moving sheet of paper being produced, there is a need for providing a drying technique which eliminates moisture streaks in the moving or machine direction of the web to therefore provide a smooth cross-direction moisture profile. The above co-pending application discloses and claims details of a dryer unit which are utilized in the present invention. Thus, the above co-pending application is incorporated herewith by reference.

One problem that is inherent in any paper making process with a moving web is the inevitable flutter or movement of the paper in the direction perpendicular to the direction of movement of paper itself normally termed the "machine direction". One solution to this problem is installing heater apparatus as disclosed in the above co-pending STEPHANSEN patent application at a point of the paper making process where the paper is more stable; for example, as it is entering or is on, for example, a calender roll. Or, alternatively, when the paper is entering or being rolled over the cylindrical steam drums which are also used for the drying of the paper web. But, of course, this technique can normally only be used where the dryer occupies only one surface of the paper.

Where it is desired to utilize a dryer technique where the apparatus is juxtaposed on opposite sides of the moving sheet or web with the units facing one another then the problem of paper movement may be significant. One solution suggested is by a Smith, Jr. U.S. Pat. No. 3,793,741 which illustrates heating units on opposite sides of a moving web and shows inclined nozzles which while used for drying also are set to minimize the flutter of the web. However, this is mentioned only as incidental effect to the desired "scouring" action of the air from the nozzles. In addition, the Smith, Jr. patent appears to be directed more toward materials other than simple paper which require the removal of "volatiles" which implies thicker materials such as fiberboard, etc., where the flutter problem is less.

One final comment on the flutter problem and that is to avoid breakage or tearing the heater apparatus when it is, for example, in an elongated structural member which lies across the paper, should not contact the moving material.

One simple way of achieving this is spacing it far enough away; but this, of course, decreases drying efficiency.

Thus, it is an object of the present invention to provide an air bearing support apparatus for drying a moving web.

It is another object of the present invention to improve the radiant heating coupling efficiency to the moving web.

In accordance with the above objects, the air bearing support apparatus comprises a first elongated structural member having a length at least as great as the web in a transverse cross-direction and carrying a plurality of side-by-side heater modules for drying the web. It includes an air plenum connected to all of the heater modules. Forced air means supply air to the plenum. Each dryer module includes a plurality of heater elements in close proximity to the web and a solid barrier carried by the dryer module between the heater elements and the web. The barrier is substantially transparent to the heat producing radiation of the heater elements. The barrier includes at least one narrow slit parallel to the line of movement of the web for allowing the passage of air from the air plenum to the space between the web and barrier.

Juxtaposed on the opposite side of the web is a second elongated structural member, the two structural members providing a gap in which the web may be inserted for movement. The solid barrier of the second member includes narrow slits, also parallel to the line of movement of the web.

The second member includes an air plenum connected to all of the slits of its solid barrier for allowing the passage of air from the air plenum to the space between the web and the barrier. Thus, an air bearing is provided for the moving web inserted in the gap. Forced air means also supply air to the air plenum of the second elongated structural member.

BRIEF DESCRIPTION OF THE DRAWINGS

FIG. 2 is a perspective view partially simplified of one of the structural members of FIG. 1.

FIG. 2A is a perspective view of an end plate of FIG. 2.

FIG. 3 is an enlarged cross-sectional view of FIG. 2.

DESCRIPTION OF PREFERRED EMBODIMENT

Figure 1:
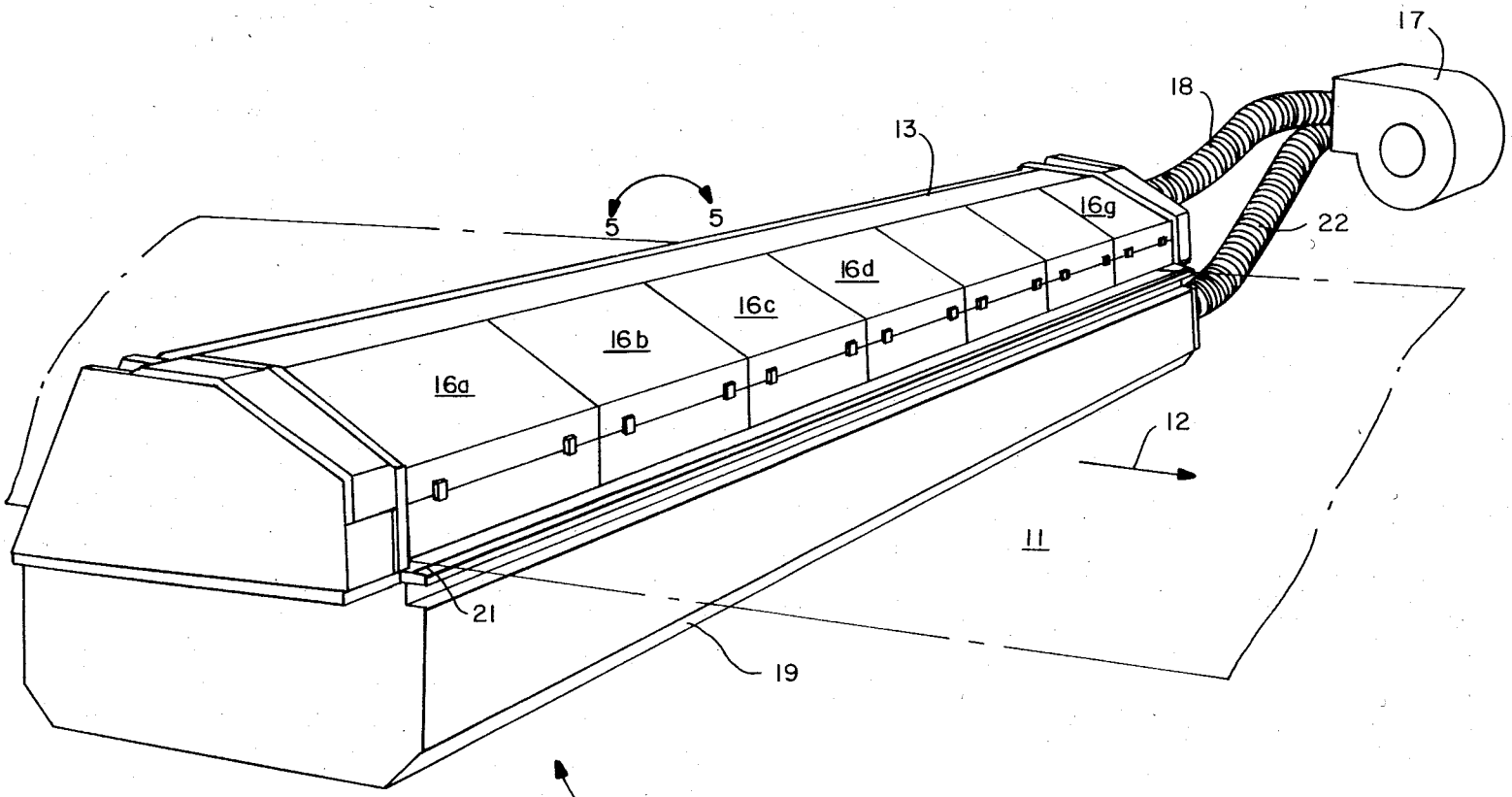
FIG. 1 is a perspective view of apparatus embodying the present invention and showing its installation with a moving web of material.

FIG. 1 shows the air bearing support apparatus for dryer 10 for driving a moving paper sheet 11 which is moving in a machine direction 12 as indicated by the arrow. The drying apparatus includes for its upper half on one side of moving web 11 an elongated structural member 13 which includes a plurality of side-by-side heater modules **16*a* through 16*g*. These are individually controlled as discussed in the co-pending STEPHANSEN ET AL application to allow for individual zones or slices of the paper to be dried to individual specifications. Unit 13 would be mounted on a support which would, for example, allow its tilting away from the paper for servicing, etc. A forced air blower 17 is connected via flexible conduit 18 to a plenum in member 13 to provide cooling air to the heater modules as discussed in the co-pending application. In addition, the forced air supplied by blower 17 provides air which forms one-half of the air bearing support for the moving web 11**.

The other half of this air bearing support is provided by a second elongated structural member 19 which is on the other side of web 11 from unit 13 and opposite or juxtaposed to such unit. Thus, a gap 21 is provided through which web 11 may be inserted for movement. Member 19 also is connected to blower 17 via flexible conduit 22 to provide forced air which provides the other half of the air bearing for moving web 11 as will be discussed below in detail.

Upper elongated member 13 is substantially identical to the unit disclosed in one of the embodiments of the above co-pending STEPHANSEN ET AL application.

The lower member 19 is better illustrated in FIGS. 2 and 3 and 19 includes an air plenum 23 which also forms the main structural support to support the unit across the width or cross-direction of the moving web. Plenum 23 is connected to blower 17 and the conduit 22 via the end plate 24 as illustrated in FIG. 2A which closes the end of plenum 23. The top of plenum 23, consists of the side rails 25*a*, 25*b* which are bridged by a perforated plate 26. Plate 26 is best shown in FIG. 3 and constitutes approximately a ten percent opening and provides a slight back pressure for plenum 23.

Retained on top of plenum 23 are a plurality of ceramic tiles 27 which form a solid barrier but which include the center slits 31*a* for allowing the passage of air from the plenum to the space between the moving web 11 and the barrier 27 to thereby form a lower air bearing. There are also slits 31*b* formed between adjacent barriers as will be discussed below. Each barrier 27 is retained at its ends by C-shaped retainer brackets 28*a* and 28*b* which are affixed to the side rails 25*a* and 25*b*. Each ceramic tile is preferably of white material or a reflecting material to reflect back the heat radiated by the upper heater unit which passes through the moving web. Thus, the coupling efficiency of the radiation to the web is improved.

Figure 4:
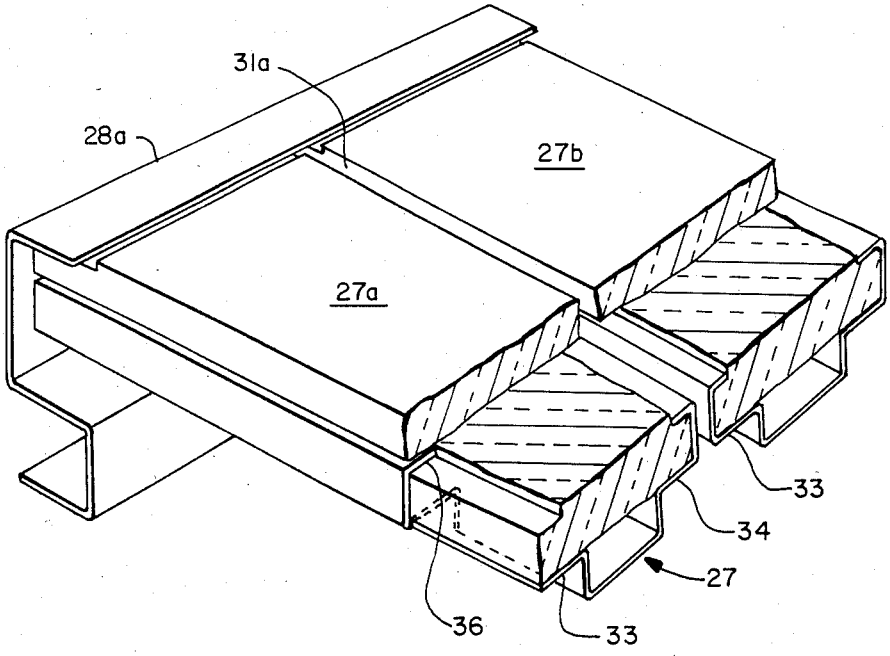
FIG. 4 is a perspective view partially cut-away showing a cross-section substantially taken along lines 4—4 of FIG. 3.

FIG. 4 illustrates the structural detail of the ceramic tile 27 which actually consists of two units 27*a* and 27*b* in each module. Each tile module corresponds to a heater module. The ends of the tile are retained by the brackets 28*a*, 28*b* and the sides of the tile units are retained by the S-shaped units 33 and 34 which are tied together by plate 35 and, thus, for a unitary structure for easier assembly. These units are affixed to the end bracket 28*a* and 28*b* and retain the tile 27 by means of a portion of each side rail 33 and 34 extending into a slot 36 in the tile. In the middle of the structure shown in FIG. 4, the slot 31*a* is formed by the partition of the tiles 27*a* and 27*b*.

FIG. 4 better illustrates the entire air bearing arrangement formed by the juxtaposed positions of the upper elongated member 13 and the lower member 19. With regard to lower member 19, the two tiles 27*a* and 27*b* are illustrated which in effect form a modular unit which exactly corresponds to a modular or heating unit 16, for example, 16*c* of the upper elongated member 13. Very briefly this unit includes a plurality of quartz tube-like heater elements 41 which are aligned paralleled to the direction of the movement of web 11. Above the heater elements 41 is a solid ceramic barrier 42 which, as discussed in the co-pending application, blocks the re-radiation of heat into the air plenum of the unit 13, a portion of which 43 is illustrated, but rather directs the air to the ends of the heater elements 41 and then against the quartz glass barrier in the form of sections 44*a* and 44*b* which includes the center slit 46*a*.

As discussed in the co-pending above application, air flows from plenum 43 around the ends of the heaters 41 and vents through the center slit 46*a* to the space between moving web 11 and the barrier 44.

The slit 46*a* is exactly juxtaposed with the slit 31*a* of the lower unit 19. This is believed to provide a more effective air bearing effect. Additional slits between adjacent heater modules, for example, the heater modules 16*b* and 16*d* are provided by the fact that the barriers 44 are retained only by their ends, in a manner similar to that illustrated in FIG. 4, and that they are narrowed so that they do not extend fully the width of the module 16 to allow the additional slits 46*b* between adjacent heater modules. Thus, an upper bearing is formed in the space between the barrier 44 and the web 11 by the air flow indicated by the arrows through the slits 46*a*, the center slit of the barrier, and the additional slits 46*b* which occur between one heater module and adjacent heater modules.

Juxtaposed with these slits 46*a* and 46*b* are the similiar corresponding slits of the lower structural member 19 which includes a center slit 31*a* and also the slits 31*b* formed between adjacent modules of ceramic tiles. The total width of the tiles 27*a* and 27*b* is narrower than the end bracket 28*a*, as is best illustrated in FIG. 4, to thus allow a slit to be formed between adjacent tile modules.

If the slits do not line up exactly, the stability of the web may be reduced but a sufficiently effective air bearing effect may still be provided in many situations.

Figure 5:
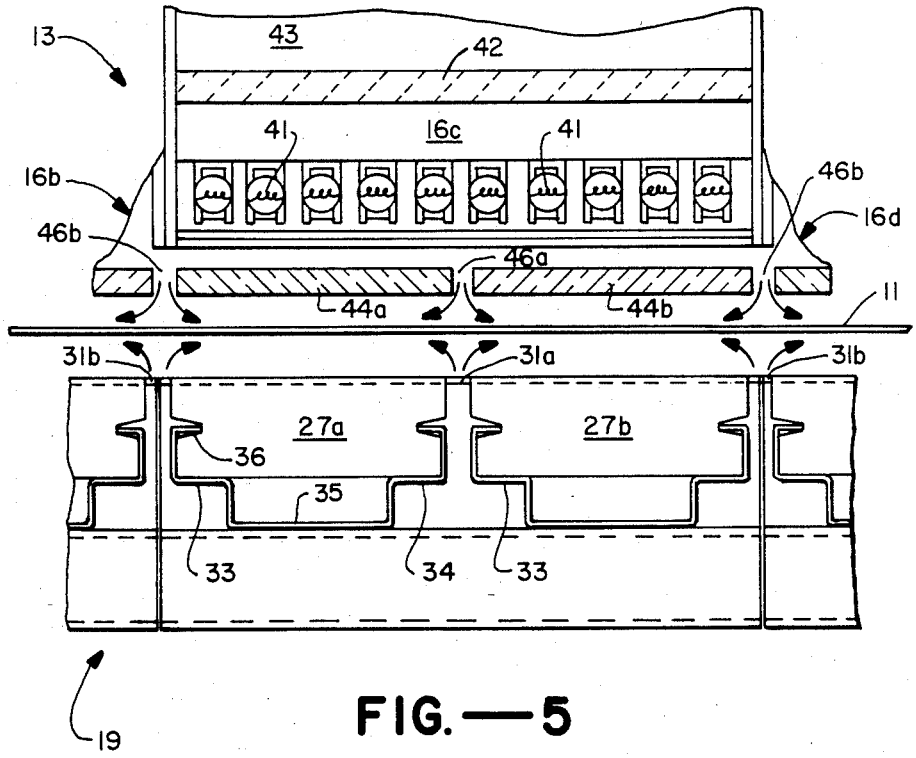
FIG. 5 is a cross-sectional view taken substantially along lines 5—5 of FIG. 1.

With the above construction, as best illustrated in FIG. 5, an air bearing support is provided for the moving web 11 which allows location of the heater module portion of this structure in locations, for example, of a paper making machine where otherwise the flutter of the paper would be too great. If drying requirements are greater, rather than have an inactive lower unit 19, heater modules would be provided identical to that of upper unit 13 in either a portion or all of the lower unit. It is believed that a very stable air bearing web support is provided by the fact that at least the center slits 46*a* and 31*a* extend in the machine direction of the moving web, substantially all the way across the entire width of the structural member itself. This is believed to be an improved preferred arrangement compared to the use of nozzles. In addition, the foregoing air bearing support arrangement provides concomitant advantages as outlined in the co-pending STEPHANSEN ET AL application of cooling the heater elements and glass barrier and providing a curtain of air against the moist moving web 11 which sweeps away the moisture. Finally, it is believed that with the juxtaposed position of the slots with one another this gives good edge air bearing affects. Thus, an air bearing dryer unit for a moving web has been provided.

What is claimed:

1. Air bearing support apparatus for drying a moving web comprising:

first elongated structural member having a length at least as great as said web in a transverse cross-direction and carrying a plurality of side-by-side heater modules for drying said web, and including an air plenum connected to all of said heater modules;

forced air means for supplying air to said air plenum;

each dryer module including a plurality of heater elements in close proximity to said web and including a solid barrier carried by said dryer module between said heater elements and said web, substantially transparent to the heat producing radiation of said heater elements, and including at least one narrow slit in said barrier parallel to the line of movement of said web for allowing the passage of air from said air plenum to the space between said web and barrier;

a second elongated structural member having solid barrier means which are juxtaposed with said solid barriers of said first elongated member to provide a gap there between in which said web may be inserted, said solid barrier of said second member including narrow slits parallel to said line of movement of said web and said solid barrier of said second member is reflective to said heat producing radiation whereby any radiation passing through said moving web will be reflected back;

said second member including an air plenum connected to all of said slits of said solid barrier of said second member for allowing the passage of air from said air plenum to the space between said web and said barrier of said second member, whereby an air bearing is provided for said moving web when inserted in said gap; and forced air means for supplying air to said air plenum of said second member.

2. Apparatus as in claim 1 where said barriers of said first member which are adjacent include an additional slit therebetween for air flow between adjacent heater modules to said space and said barrier means of said second member also includes additional slits for allowing air flow.

3. Apparatus as in claim 1 or claim 2 where said slits of said second member are juxtaposed with said slits of said first member.

4. Apparatus as in claim 1 where said solid barrier of said second member consists of ceramic tiles.

5. Apparatus as in claim 1 or 2 where said slits extend substantially across the width of said first and second members.

* * * * *